US011814839B2

(12) United States Patent
Colin et al.

(10) Patent No.: US 11,814,839 B2
(45) Date of Patent: Nov. 14, 2023

(54) MOBILE WALL INCLUDING AN ALIGNMENT MECHANISM

(71) Applicant: MILLERKNOLL, INC., Zeeland, MI (US)

(72) Inventors: Kimberlee Colin, London (GB); Luca Corvatta, London (GB); Samuel Hecht, London (GB); John Matthai, Holland, MI (US)

(73) Assignee: MILLERKNOLL, INC., Zeeland, MI (US)

( * ) Notice: Subject to any disclaimer, the term of this patent is extended or adjusted under 35 U.S.C. 154(b) by 172 days.

(21) Appl. No.: 17/082,963

(22) Filed: Oct. 28, 2020

(65) Prior Publication Data

US 2022/0127846 A1 Apr. 28, 2022

(51) Int. Cl.

| | |
|---|---|
| ***E04B 2/74*** | (2006.01) |
| ***A47F 5/00*** | (2006.01) |
| ***A47B 96/02*** | (2006.01) |
| ***A47B 47/02*** | (2006.01) |

(52) U.S. Cl.

CPC ..... *E04B 2/7425* (2013.01); *A47B 47/027* (2013.01); *A47B 47/028* (2013.01); *A47B 96/02* (2013.01); *A47F 5/0062* (2013.01)

(58) Field of Classification Search

CPC ..... E04B 2/7425; E04B 2/7422; E04B 2/827; A47B 96/02; A47B 83/001; A47B 87/008; A47B 47/028; A47F 5/0062

USPC ..... 52/204.51, 239; 403/380, 388, 324; 160/351

See application file for complete search history.

(56) References Cited

U.S. PATENT DOCUMENTS

| | | | | |
|---|---|---|---|---|
| 3,453,790 | A | 7/1969 | Harris | |
| D223,331 | S | 4/1972 | Neerincx | |
| 3,802,146 | A | 4/1974 | Tacke et al. | |
| 3,877,764 | A * | 4/1975 | Hillier, Jr. | A47B 87/00 312/107 |
| 4,034,524 | A | 7/1977 | Fromme et al. | |
| 4,122,781 | A * | 10/1978 | Potter | A47G 7/041 108/189 |

(Continued)

FOREIGN PATENT DOCUMENTS

| | | | |
|---|---|---|---|
| CN | 108755978 | A | 11/2018 |
| EP | 1029996 | A2 | 8/2000 |

(Continued)

OTHER PUBLICATIONS

International Search Report with Written Opinion for related Application No. PCT/US2021/056807 dated Feb. 1, 2022 (13 Pages).

(Continued)

*Primary Examiner* — Brent W Herring

(74) *Attorney, Agent, or Firm* — MICHAEL BEST & FRIEDRICH LLP

(57) ABSTRACT

A mobile wall comprising an alignment pin moveably supported on a crossbar adjacent a vertical support. The alignment pin is selectively moveable between a retracted position, in which the alignment pin is retracted into a first aperture, and an extended position, in which at least a portion of the alignment pin extends outwardly from the first aperture. The alignment pin is selectively receivable in an aperture of another mobile wall while in the extended position to align the mobile wall with the another mobile wall.

16 Claims, 7 Drawing Sheets

(56) References Cited

U.S. PATENT DOCUMENTS

| | | | | |
|---|---|---|---|---|
| 4,128,286 | A | 12/1978 | Windisch et al. | |
| 4,433,881 | A * | 2/1984 | Witten | A47B 96/00 312/107 |
| D279,201 | S | 6/1985 | Shuman | |
| 4,699,270 | A * | 10/1987 | Bohm | H05K 5/0021 220/532 |
| 4,844,565 | A * | 7/1989 | Brafford | H02B 1/308 312/111 |
| 5,138,745 | A * | 8/1992 | Rentschler | E05D 15/266 160/206 |
| 5,172,529 | A | 12/1992 | Van De Riet | |
| 5,347,778 | A * | 9/1994 | Bray | E04B 2/7425 52/582.1 |
| 5,403,232 | A | 4/1995 | Helm et al. | |
| 5,431,509 | A * | 7/1995 | Anderson | H05K 5/0204 403/380 |
| 5,529,192 | A | 6/1996 | Conen et al. | |
| D397,562 | S | 9/1998 | DePottey et al. | |
| D400,737 | S | 11/1998 | DePottey et al. | |
| D407,501 | S | 3/1999 | Shipman et al. | |
| 5,938,302 | A * | 8/1999 | Anderson | A47B 96/145 312/265.3 |
| 6,058,667 | A | 5/2000 | MacDonald et al. | |
| 6,067,762 | A | 5/2000 | Greer et al. | |
| 6,164,467 | A | 12/2000 | DePottey et al. | |
| 6,272,795 | B1 | 8/2001 | Brauning | |
| 6,443,542 | B1 * | 9/2002 | Lindquist | A47B 87/008 312/111 |
| 6,510,955 | B2 * | 1/2003 | Pellegrino | F16B 7/0446 211/192 |
| 6,527,406 | B1 | 3/2003 | Slesinger et al. | |
| 6,598,649 | B1 | 6/2003 | Moore et al. | |
| D481,466 | S | 10/2003 | Mueller et al. | |
| 6,712,118 | B2 * | 3/2004 | Nussdorf | G09F 15/0068 40/605 |
| 6,820,758 | B2 * | 11/2004 | May | A47B 57/50 403/324 |
| 6,955,410 | B1 * | 10/2005 | Nelson | H05K 5/0021 312/352 |
| 7,008,027 | B2 * | 3/2006 | Kelley | A47B 87/008 312/107 |
| 7,357,428 | B2 | 4/2008 | Kletscher | |
| 7,722,141 | B2 * | 5/2010 | Parise | B25H 3/00 312/352 |
| 7,841,142 | B2 | 11/2010 | Towersey et al. | |
| D661,124 | S | 6/2012 | Curbbun et al. | |
| D662,329 | S | 6/2012 | Arko et al. | |
| 8,505,860 | B2 | 8/2013 | Schluter | |
| 8,528,288 | B1 | 9/2013 | Kinser, Jr. | |
| 8,534,021 | B2 | 9/2013 | Liu et al. | |
| 8,713,857 | B2 | 5/2014 | Logue | |
| D708,459 | S | 7/2014 | Heirakuji et al. | |
| 9,076,354 | B1 | 7/2015 | Peota et al. | |
| 9,222,255 | B2 | 12/2015 | Johnson et al. | |
| 9,315,985 | B2 | 4/2016 | Gosling et al. | |
| D758,106 | S | 6/2016 | Hamm et al. | |
| D767,922 | S | 10/2016 | Jussila | |
| D779,240 | S | 2/2017 | Tio et al. | |
| D781,080 | S | 3/2017 | Jordan et al. | |
| 9,615,681 | B2 | 4/2017 | Goranson et al. | |
| 9,732,510 | B2 | 8/2017 | Johnson et al. | |
| 9,782,018 | B2 | 10/2017 | Hester-Redmond | |
| 9,924,613 | B2 | 3/2018 | Pace et al. | |
| 9,936,825 | B1 * | 4/2018 | Lindblom | A47F 5/0087 |
| RE47,132 | E | 11/2018 | Gosling et al. | |
| 10,221,580 | B2 | 3/2019 | Connors | |
| D877,546 | S | 3/2020 | Spielmann | |
| 10,689,844 | B2 | 6/2020 | Patton et al. | |
| 2002/0060198 | A1 * | 5/2002 | Bustos | A47F 5/0018 211/187 |
| 2002/0095890 | A1 | 7/2002 | Brauning | |
| 2007/0277946 | A1 | 12/2007 | Galvan | |
| 2015/0176273 | A1 | 6/2015 | Farouk | |
| 2017/0150814 | A1 * | 6/2017 | Chen | A47F 5/0093 |
| 2020/0163470 | A1 * | 5/2020 | Chen | A47F 5/0093 |
| 2022/0127846 | A1 | 4/2022 | Colin et al. | |

FOREIGN PATENT DOCUMENTS

| | | | |
|---|---|---|---|
| EP | 1849925 | A1 | 10/2007 |
| EP | 2444562 | A2 | 4/2012 |
| EP | 2767644 | A1 | 8/2014 |
| IN | 246181-0001 | | 5/2013 |
| JP | 4863656 | B2 | 1/2012 |
| WO | WO9401647 | A1 | 1/1994 |
| WO | WO2002008851 | A1 | 1/2002 |
| WO | WO 2010010232 | A1 | 1/2010 |

OTHER PUBLICATIONS

MarxModa, Product Spotlight, OE1 Agile Wall website: https://marxmoda.com/news/2021/product-spotlight-oe1-agile-wall May 3, 2021, 8 Pages.

OE1 Workspace Collection, Portfolio, Herman Miller, website: https://www.hermanmiller.com/products/portfolios/oe1-workspace-collection/ Apr. 8, 2021, 18 Pages.

* cited by examiner

MOBILE WALL INCLUDING AN ALIGNMENT MECHANISM

FIELD OF THE INVENTION

The present invention relates to moveable wall structures, and more particularly to alignment mechanisms for aligning adjacent moveable walls with one another.

SUMMARY

The invention provides, in one aspect, a mobile wall including a base having one or more ground engaging members configured to moving the base along a surface, and first vertical support extending from the base. The first vertical support includes a first aperture. The mobile wall also includes a second vertical support extending from the base and spaced apart from the first vertical support, a crossbar extending between the first and second vertical supports, and an alignment pin moveably supported on the crossbar adjacent the first vertical support. The alignment pin is selectively moveable between a retracted position, in which the alignment pin is retracted into the first aperture, and an extended position, in which at least a portion of the alignment pin extends outwardly from the first aperture. The alignment pin is selectively receivable in an aperture of another mobile wall while in the extended position to align the mobile wall with the another mobile wall.

The invention provides, in another aspect, a mobile wall system including a first mobile wall including a first base having one or more ground engaging members configured for moving the first base along a surface, a first vertical frame structure extending upwardly from the first base, and an alignment pin moveably supported on the first vertical frame structure. The mobile wall system also includes a second mobile wall including a second base having one or more ground engaging members configured for moving the second base along the surface, and a second vertical frame structure extending upwardly from the second base and including an aperture. The alignment pin of the first mobile wall is moveable relative to the first vertical frame structure into the aperture of the second mobile wall to retain the first and second mobile walls in non-locking alignment.

The invention provides, in yet another independent aspect, a mobile wall including a base having one or more ground engaging members configured for moving the base along a surface, and a vertical frame structure extending upwardly from the base. The vertical frame structure includes an outer surface and an aperture formed in the outer surface. The mobile wall also includes an alignment pin moveably supported by the vertical frame structure. The alignment pin has a distal end configured to engage another mobile wall to align the mobile wall with the another mobile wall. The alignment pin is extendable out of the aperture such that the distal end is spaced a first distance from the outer surface. The alignment pin is also retractable into the aperture such that the distal end is spaced a second distance from the outer surface that is equal to or greater than the first distance.

Other aspects of the invention will become apparent by consideration of the detailed description and accompanying drawings.

FIB. 6B is a bottom perspective view of a mobile wall according to yet another embodiment of the invention.

Figure 7:
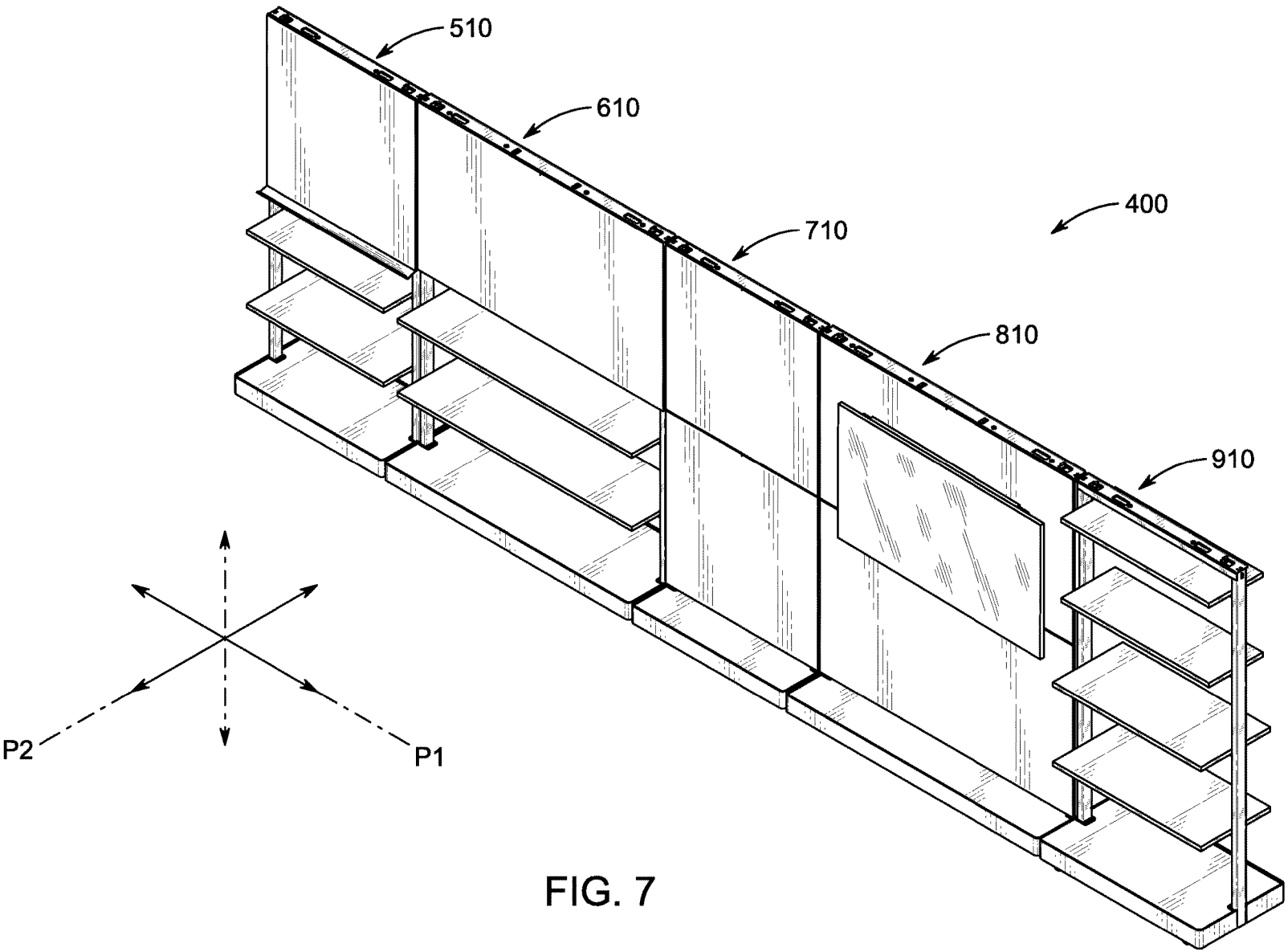

FIG. 7 is a perspective view of a mobile wall system including five mobile walls aligned with one another.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
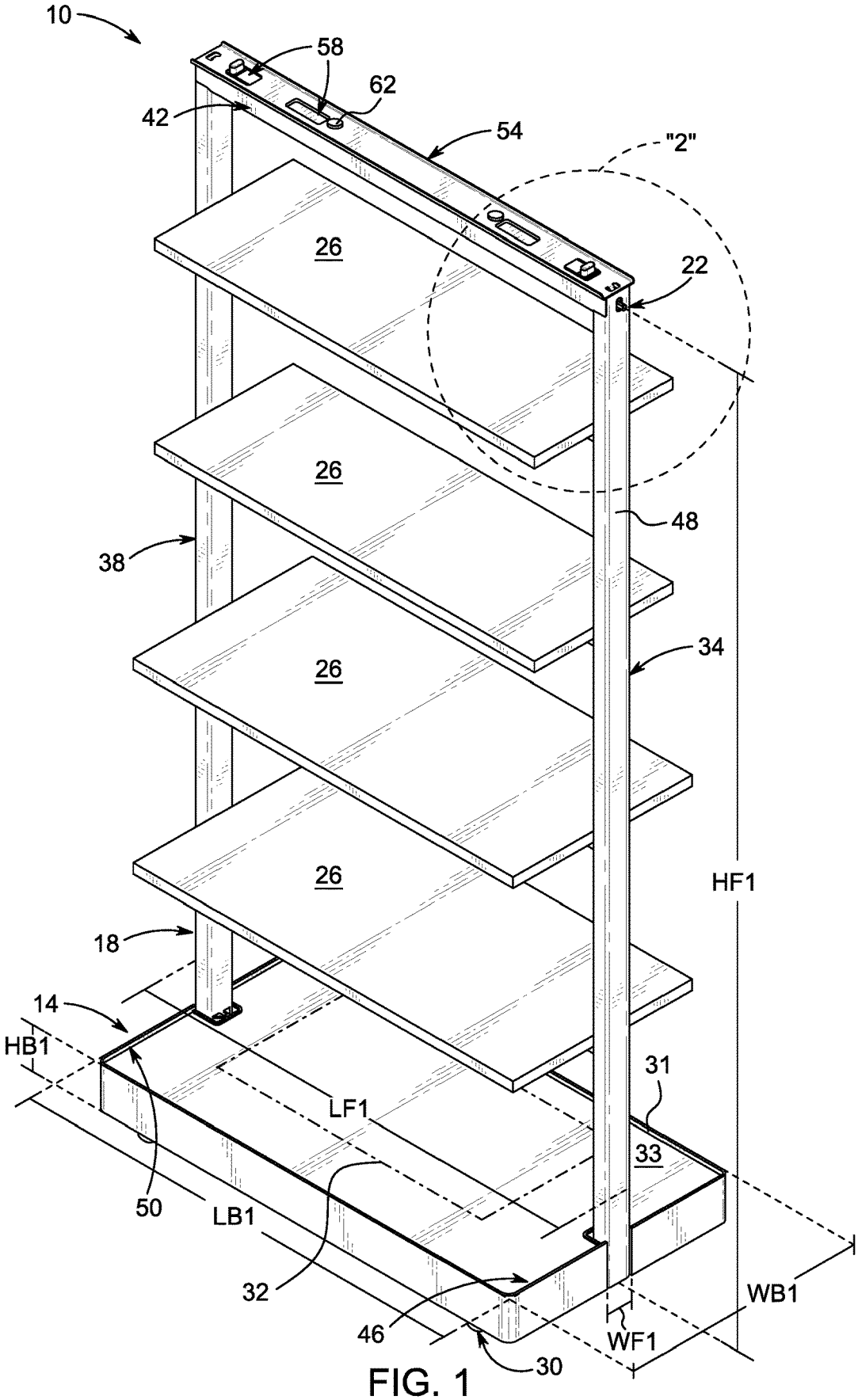
FIG. 1 is a perspective view of a mobile wall according to one embodiment of the invention.

FIG. 1 illustrates a mobile wall 10. The illustrated mobile wall 10 includes a base 14, a vertical frame structure 18 extending upwardly from the base 14, and one or more alignment pins 22 moveably supported on the frame structure 18. The illustrated mobile wall 10 also includes one or more wall accessories 26 that are coupled to the frame structure 18. The mobile wall 10 may be manufactured or assembled with different wall accessories or combinations of wall accessories to have different configurations, as described in greater detail below. The alignment pins 22 facilitate aligning the mobile wall 10 with another mobile wall, or other structure, in a non-locking manner.

The illustrated base 14 is a horizontal base having a rectangular outer profile. The base 14 has a base length LB1, a base width WB1, and a base height HB1. The base length LB1 is measured in a side-to-side direction of the mobile wall 10. The base width WB1 is measured in a front-to-back direction of the mobile wall 10. The base height HB1 is measured in a top-to-bottom direction of the mobile wall 10. In the illustrated embodiment, the base length LB1 is larger than the base width WB1 and the base height HB1, and the base width WB1 is larger than the base height HB1. In other embodiments, the base 14 may have other configurations, such as rounded, square, circular, oblong, hexagonal, and the like.

The base 14 includes one or more ground engaging members 30. The ground engaging members 30 are supported on an underside of the base 14 for accommodating movement of the wall 10 along a surface. Although not fully shown in FIG. 1, the ground engaging members 30 may be similar to ground engaging members 230, 330 shown in FIGS. 6A and 6B. In the illustrated embodiment, the ground engaging members 30 are caster wheels 30 that allow the wall 10 to be moved in any direction along a floor surface (e.g., front-to-back, side-to-side, clockwise, counter-clockwise, etc.). In other embodiments, the base 14 may include other types of ground engaging members, such as wheels, rollers, sliders, tracks, and the like.

The base 14 also includes a tray 31 to receive and hold a weight 32. The weight 32 may be a relatively heavy block of material, such as concrete or metal. The weight functions as a counterweight to improve the stability of the mobile wall 10 and counteract any tipping actions. In the illustrated embodiment, the tray 31 is covered by an upper panel 33 such that the weight 32 is covered and hidden. The upper panel 33 provides a clean and finished appearance for the base 14.

With continued reference to FIG. 1, the illustrated frame structure 18 extends upwardly from the base 14 and has a rectangular outer profile. The frame structure 18 has a frame length LF1, a frame width WF1, and a frame height HF1. The frame length LF1 is measured in the side-to-side direction of the mobile wall 10 and is parallel to the base length LB1. The frame width WF1 is measured in the front-to-back direction of the mobile wall 10 and is parallel to the base width WB1. The frame height HF1 is measured in the top-to-bottom direction of the mobile wall 10 and is parallel to the base height HB1. In the illustrated embodiment, the frame height HF1 is larger than the frame length LF1 and the frame width WF1, and the frame length LF1 is larger than the frame width WF1. In other embodiments, the frame structure 18 may have other configurations.

Compared to the base 14, the frame structure 18 profile is relatively tall and thin, whereas the base 14 is relatively short and flat. The base width WB1 of the base 14 is broad compared to the frame width WF1 of the frame 16, and the frame height HF1 of the frame 16 towers over the base height HB1 of the base 14. The base length LB1 of the base 14 and the base length LF1 of the frame 18, however, are substantially similar. In some embodiment, the frame height HF1 is at least twenty times greater than the base height HB1, and at least two times greater than the base length BF1 or frame length LF1. In other embodiments, the frame structure 18 may have other dimensions relative to the base 14.

The illustrated frame structure 18 includes a first vertical support 34, a second vertical support 38, and at least one crossbar 42 extending between the first and second vertical supports 34, 38. The first vertical support 34 extends from the base 14 adjacent a first side 46 of the base 14. The second vertical support 38 extends from the base 14 adjacent a second side 50 of the base 14. As such, the second vertical support 38 is spaced apart from the first vertical support 34 along the base length LB1 or the frame length LF1. Although the first and second vertical supports 34, 38 are separated from one another along the base length LB1, the first and second vertical supports 34, 38 are aligned with one another along the base width WB1. Stated another way, the first and second vertical supports 34, 38 are separated along a long direction of the base 14, but are centered and aligned along a short direction of the base 14.

In the illustrated embodiment, each of the first and second vertical supports 34, 38 is a generally square tube. In other embodiments, the first and second vertical supports 34, 38 may have other shapes or profiles. Each of the first and second vertical supports 34, 38 further includes an outer surface 44, 48. The outer surface 44 of the first vertical support 34 is the surface facing away from the second vertical support 38 and outwardly from the mobile wall 10. The outer surface 48 of the second vertical support 38 is the surface facing away from the first vertical support 34 and outwardly from the mobile wall 10. In the illustrated embodiment, the outer surface 44 of the first vertical support 34 is aligned with the first side 46 of the base 14, and the outer surface 48 of the second support 38 is aligned with the second side 50. The vertical supports 34, 38 are, therefore, flush with the first and second sides 46, 50 of the base 14. In this manner, the base 14 and the frame structure 18 of the mobile wall 10 presents a flat surface to contact another mobile wall or other structure. In other embodiments, the first and second vertical supports 34, 38 may be recessed relative to the first and second sides 46, 50 of the base 14 or may be supported on an upper surface of the base 14.

The first vertical support 34 and second vertical support 38 each include vertically spaced crossbar mounting regions. Each mounting region of the first support member 34 is aligned with a complimentary mounting region of the second support member 38. The mounting regions couple the crossbars 42 to the vertical supports 34, 38. The vertical supports 34, 38 and the crossbars 42 form the frame structure 18.

In the illustrated embodiment, the frame structure 18 includes five crossbars 42. Although only one crossbar 42 (i.e., an upper or first crossbar) is visible in FIG. 1, other similar crossbars are shown in, for example, FIG. 6A. The crossbars 42 are configured to support the wall accessories 26. The crossbars 42 also improve the strength and rigidity of the frame structure 18. In other embodiments, the frame structure 18 may include fewer or more crossbars 42, or the crossbars 42 may be omitted. In such embodiments, the wall accessories 26 may be attached directly to the support members 34, 38, or even to the base 14. In the illustrated embodiment, the mounting regions are vertically spaced from one another on each of the support members 34, 38, and crossbars 42 extend between horizontally aligned mounting regions in a horizontal orientation. In another embodiment, the crossbars 42 could extend between mounting regions at different heights and/or in angled orientations. In other embodiments, the crossbars 42 may cross one another and extend between the support members 34, 38 in an "X" configuration.

As noted above, the frame structure 18 supports the wall accessories 26. In the embodiment shown in FIG. 1, the first crossbar 42 located at a top of the frame structure 18 does not support a wall accessory. The other of the crossbars 42 each support a wall accessory 26 configured as a shelf. The shelf on each crossbar 42 may have similar dimensions or different dimensions from an adjacent shelf such that the mobile wall 10 is not limited to configurations consisting of only a single type of wall accessory 26. In other embodiments, the frame structure 18 may support other types of walls accessories 26 (see, for example, FIGS. 6A, 6B, and 7). In some embodiments, one or more of the wall accessories 26 may be a cladding. Cladding may include, for example, white boards, chalk boards, tack boards, particle boards, wall tiles, mounting panels, decorative panels, display screens, lighting panels, and the like. In some embodiments, the frame structure 18 may support a combination of wall accessories 26 (e.g., shelves and cladding).

Referring still to FIG. 1, the frame structure 18 includes a cover 54 that is removably coupled to the top of the frame structure 18. The cover 54 is attached to the first crossbar 42 in the illustrated embodiment, but could be attachable to each of the first and second support members 34, 38 in other embodiments. The cover 54 includes a plurality of openings 58 formed in the cover 54 to allow access to components housed or mounted in the first crossbar 42 (e.g., the alignment pins 22). As illustrated in FIG. 1, the cover 54 and first crossbar 42 are attached to one another by a fastener 62 such as a screw, threaded shaft, magnet, weld, or the like. In some embodiments, the fastener 62 extends into the crossbar 42 and attaches the cover 54 to the crossbar 42. In other embodiments, the fastener 62 is received on any part of the frame structure 18 to secure the cover 54 on the frame structure 18. In other embodiments, the cover 54 is omitted.

Figure 2:
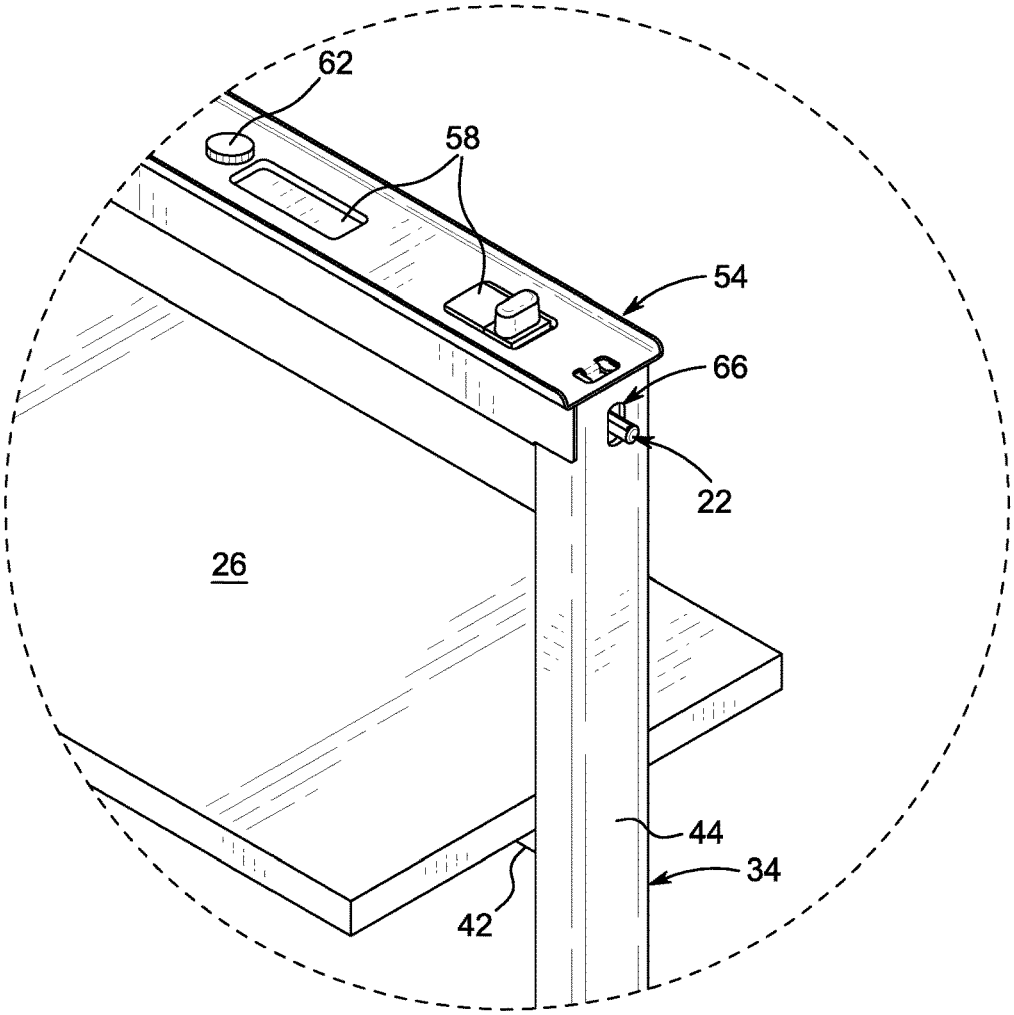
FIG. 2 is a magnified view of a portion of the mobile wall within area "2" shown in FIG. 1, illustrating an alignment pin of the mobile wall.

FIG. 2 illustrates one of the alignment pins 22 is supported by the frame structure 18. The alignment pins 22 are supported at the top of the frame structure 18. In the illustrated embodiment, the alignment pin 22 is supported by the first crossbar 42 adjacent the first vertical support 34. Another alignment pin 22 may be supported by the first crossbar 42 adjacent the second vertical support 38, as shown in FIG. 1. The alignment pins 22 are substantially the same, and only one alignment pin 22 is described in detail below. In other embodiments, the alignment pins 22 may be supported on any of the crossbars 42 adjacent either or both of the vertical supports 34, 38. In other some embodiments, the mobile wall 10 may only include a single alignment pin 22 adjacent one of the vertical supports 34, 38. In further embodiments, the mobile wall 10 may include multiple alignment pins 22 vertically spaced along either or both of the vertical supports 34, 38.

The first vertical support 34 includes an aperture 66. Although not shown, the second vertical support 38 also includes an aperture that is similar to the aperture 66 in the first vertical support 34. The illustrated aperture 66 is formed in the outer wall 44 of the first vertical support 34 and aligned with the first crossbar 42. As such, the aperture 66 is located near the top of the frame structure 18. In other embodiment, the aperture 66 can be positioned at other locations on the vertical support 34 corresponding to the location of the alignment pin 22. In some embodiments, the frame structure 18 may include one or more apertures that do not correspond to the alignment pins 22 of the mobile wall 10, but would correspond to alignment pins from adjacent mobile walls. Similar to the alignment pin 22, the frame structure 18 may include any number of apertures 66. In the illustrated embodiment, the aperture 66 is an elongated slot or through-hole. In other embodiments, the aperture 66 may be a circular hole or have other shapes. In some embodiments, the aperture 66 may be a recess, track, or groove formed in an upper surface of the frame structure 18 (and, more particularly, the first crossbar 42 or the cover 54). In further embodiments, such as embodiments, where the aperture 66 does not correspond to the alignment pin 22, the aperture 66 may be a recess or indent formed in the frame structure 18. The aperture 66 may also align with a secondary aperture, slot, or through-hole 68 (FIG. 5A) formed in the crossbar 42. In other embodiments, the crossbar 42 does not include the secondary aperture 68.

Figure 3:
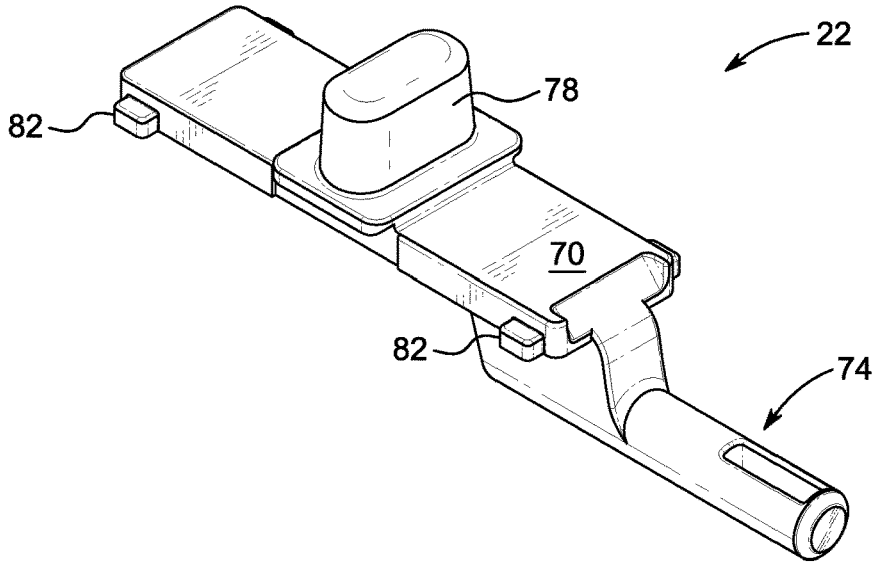
FIG. 3 is a perspective view of an alignment pin of FIG. 2.

Referring now to FIG. 3, the alignment pin 22 includes a main body 70, a distal end 74 projecting from the main body 70, an actuator 78. In the illustrated embodiment, the main body 70, the distal end 74, and the actuator 78 are integrally formed as a single piece. In other embodiments, the main body 70, the distal end 74, and the actuator 78 may be separate pieces that are coupled together. The main body 70 is received in the frame structure 18. More particularly, the main body 70 is shaped to fit at least partially within the first crossbar 42. The distal end 74 is selectively retractable into and extendable from the frame structure 18 to engage an adjacent mobile wall. In the illustrated embodiment, the distal end 74 of the alignment pin 22 is cylindrical. In other embodiments, the distal end 74 could be rectangular or another suitable geometry. For example, the alignment pin 22 may be a relatively flat tab, a rounded disk, or the like. In some embodiments, the distal end 74 may include a magnet or be magnetized. The actuator 78 is configured to be engaged by a user to move the alignment pin relative to the frame structure 18. In the illustrated embodiment, the actuator 78 extends upwardly through one of the openings 58 (FIG. 2) in the cover 54 of the first crossbar 42. In other embodiments, the actuator 78 may be accessible at other locations on the frame structure 18. The illustrated alignment pin 22 also includes a plurality of stops 82. The stops 82 limit or restrict movement of the alignment pin 22 relative to the frame structure 18.

Figure 4A:
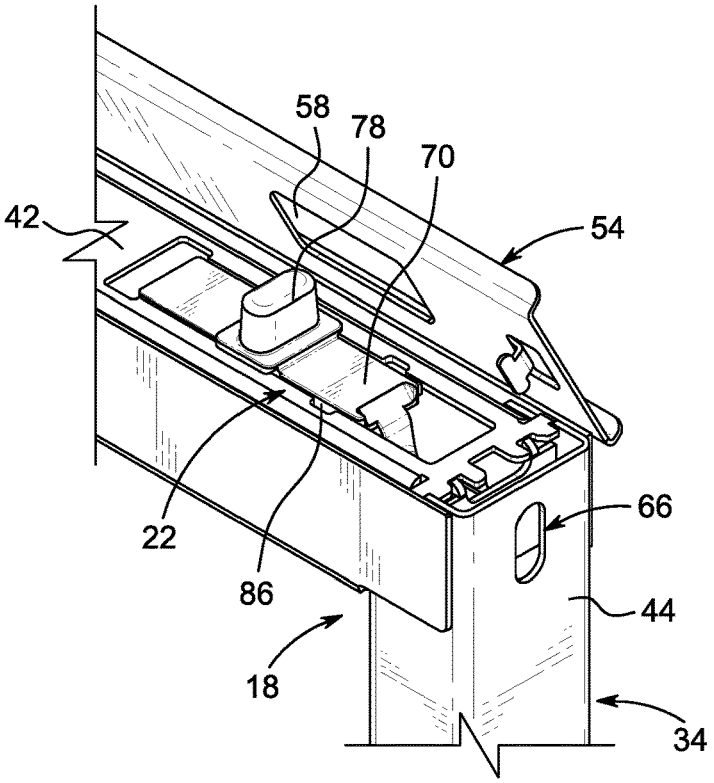
FIG. 4A is perspective view of a portion of the mobile wall with a cover removed and the alignment pin in a retracted position.
Figure 4B:
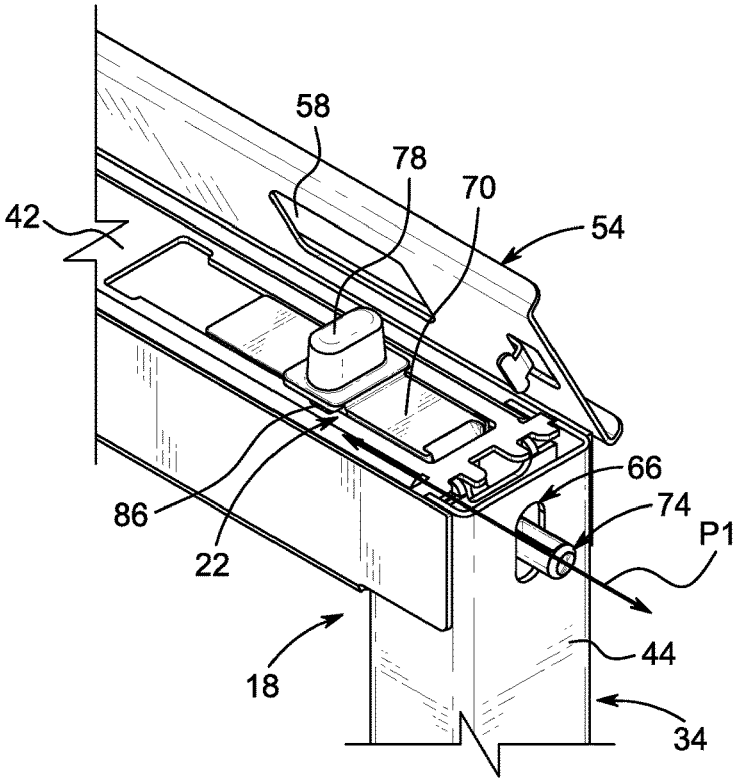
FIG. 4B is a perspective view of a portion of the mobile wall with the cover removed and the alignment pin in an extended position.

As illustrated in FIGS. 4A-4B, the alignment pin 22 is selectively movable relative to the frame structure 18 between a retracted position (FIG. 4A) and an extended position (FIG. 4B). In the illustrated embodiment, the alignment pin 22 slides linearly between the retracted position and the extended position. In other embodiments, the alignment pin 22 may pivot, rotate, or thread between the retracted position and the extended position. In the retracted position (FIG. 4A), the alignment pin 22 is retracted into the aperture 66 formed on the frame structure 18 such that the distal end 74 does not extend out of the frame structure 18. In this position, the alignment pin 22 remains relatively hidden and unobtrusive. In addition, the aperture 66 may receive an alignment pin from another mobile wall. In the extended position (FIG. 4B), the alignment pin 22 is extended out of the aperture 66 such that at least a portion of the distal end 74 extends out of the aperture 66 and beyond the frame structure 18. More particularly, the distal end 74 extends beyond the outer wall 44 of the first vertical support 34. In this position, the alignment pin 22 may engage another mobile wall to align the mobile wall 10 with the another mobile wall.

In operation, a user grasps the actuator 78 to extend the alignment pin 22 out of the aperture 66 by moving (e.g., pushing) the actuator 78 outwardly along a first direction P1. To retract the alignment pin 22, the user moves (e.g., pushes) the actuator 78 inwardly along the first path P1. The alignment pin 22 is restricted from moving to an undesired position along the first path P1 (e.g., inwardly past the retracted position, outwardly past the extended position, etc.) by the stops 82. The stops 82 engage grooves or notches 86 (FIG. 4A) to limit how far the alignment pin 22 can travel. The notches 86 are formed on the frame 18, but more particularly, may be formed on the crossbar 42 or the cover 54 to limit movement of the pin 22. In the illustrated embodiment, as more clearly shown in FIGS. 5A and 5B, the alignment pin 22 can be linearly extended out of the aperture 66 a first distance D1 from the outer surface 44 of the first vertical support 34 and retracted into the aperture 66 a second distance D2 from the outer surface 44 of the first vertical support 34. The second distance that is equal to or greater than the first distance. Stated another way, the distal end 74 is spaced on opposite sides of the outer surface 44 by generally the same amount of distance in the extended position and retracted position. Such an arrangement retracts the distal end 74 of the alignment pin 22 far enough into the frame structure 18 such that an alignment pin of another mobile wall may be extended into the aperture 66 of the mobile wall when the alignment pin 22 is in the retracted position (FIG. 4A).

Figure 5A:
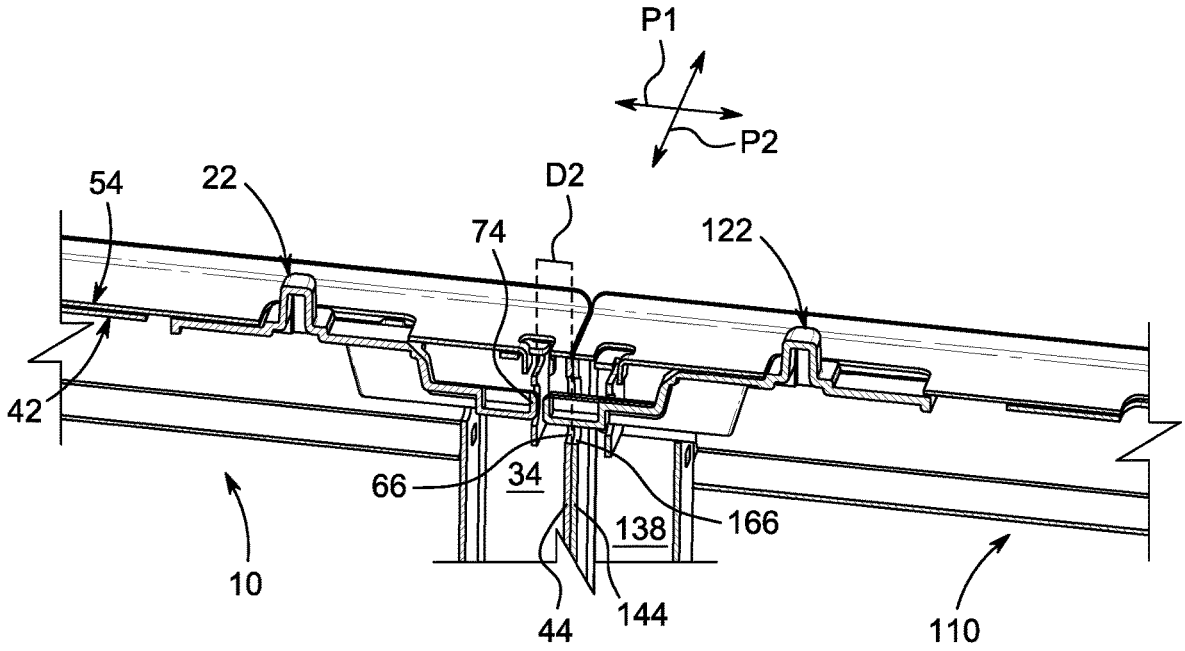
FIG. 5A is a cross-sectional view of a portion of a mobile wall system including a first mobile wall having a first alignment pin and a second mobile wall having a second alignment pin, showing the first alignment pin in a retracted position and the second alignment pin being in an extended position.
Figure 5B:
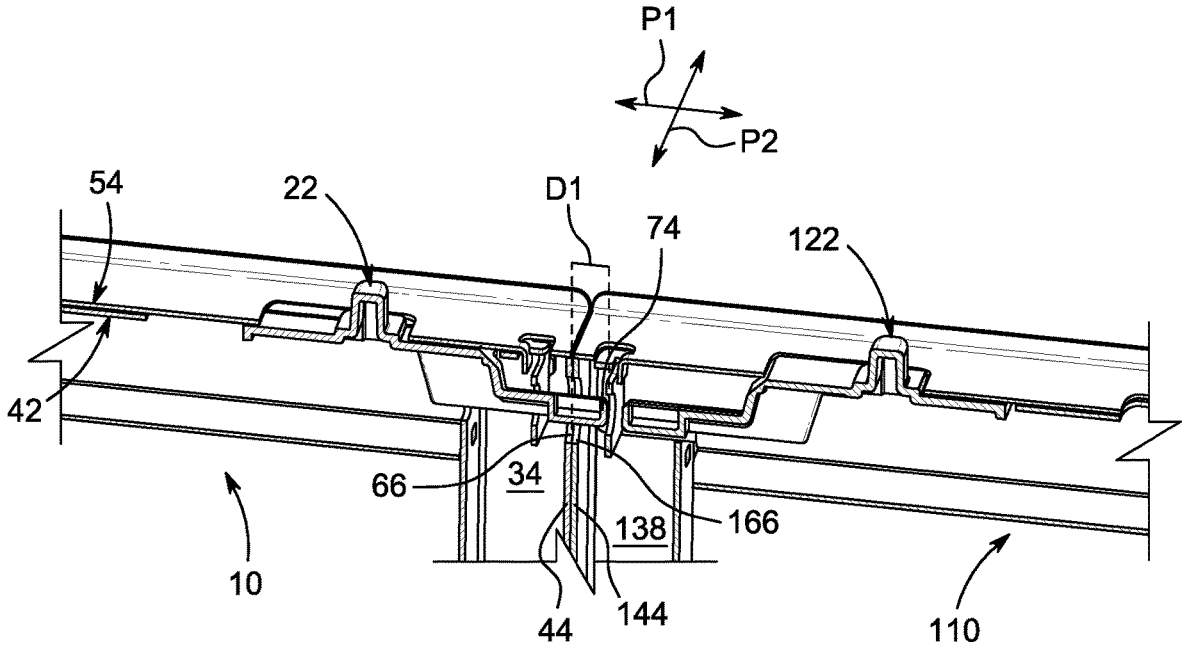
FIG. 5B is another cross-sectional view of the mobile wall system of FIG. 5A, showing the first alignment pin in an extended position and the second alignment pin in a retracted position.

FIGS. 5A and 5B illustrate a mobile wall system 100 including the mobile wall 10 (hereinafter "the first mobile wall") and another mobile wall 110 (hereinafter "the second mobile wall"). The first mobile wall 10 is aligned with the second mobile wall 110 in the first direction P1. While alignment between the mobile walls 10, 110 will be described as the first vertical support 34 of the first mobile wall 10 aligned with a second vertical support 138 of the second mobile wall 10, the non-locking alignment between the mobile walls 10 is not limited to the mobile walls 10 facing a similar direction. For example, the first vertical support 34 of the first mobile wall 10 may be arranged in non-locking alignment with either the first or second vertical support of the second mobile wall 110, and the second vertical support 38 of the first mobile wall 10 may be arranged in non-locking alignment with either the first or second vertical support of the second mobile wall 110.

FIG. 5A illustrates the alignment pin 22 of the first mobile wall 10 in the retracted position, and an alignment pin 122 of the second mobile wall 10 in the extended position. The alignment pin 122 of the second mobile wall 110 is extended outwardly from an aperture 166 formed through an outer wall surface 144 on the second mobile wall 110 and is received in the aperture 66 formed through the outer wall surface 44 on the first mobile wall 10 to align the first and second mobile walls 10, 110. FIG. 5B illustrates the alignment pin 22 of the first mobile wall 10 in the extended position, and the alignment pin 122 on the second mobile wall 110 in the retracted position. The alignment pin 22 of the first wall 10 is extended outwardly from the aperture 66 on the first mobile wall 10 and is received in the aperture 166 on the second mobile wall 10 to align the first and second mobile walls 10, 110.

As illustrated in FIGS. 5A and 5B, the first and second mobile walls 10, 110 are retained in non-locking alignment with one another while the alignment pin 22, 122 on either mobile wall 10, 110 is in the extended position and received in the aperture 66, 166 of the adjacent mobile wall 10, 110. While in non-locking alignment, the mobile walls 10, 110 are separable from one another along the first direction P1 and constrained from moving relative to one another along a second path P2 that is normal or perpendicular to the first direction P2. Neither the alignment pins 22, 122 nor the apertures 66, 166 include coupling mechanism for rigidly or securely attaching adjacent mobile walls 10, 110 to one another. The non-locking alignment or "sliding engagement" between alignment pins 22, 122 and the apertures 66, 166 of adjacent mobile walls 10, 110 allows the mobile walls 10, 110 be quickly separated from one another and accurately aligned with other mobile walls or structure. Stated another way, adjacent mobile walls 10, 110 have the alignment pins 22, 122 and the apertures 66, 166 with relative sliding engagement to cosmetically and accurately align the mobile walls 10, 110 relative one another, while still allowing the mobile walls 10, 110 to be easily rolled apart via the caster wheels.

Figure 6A:
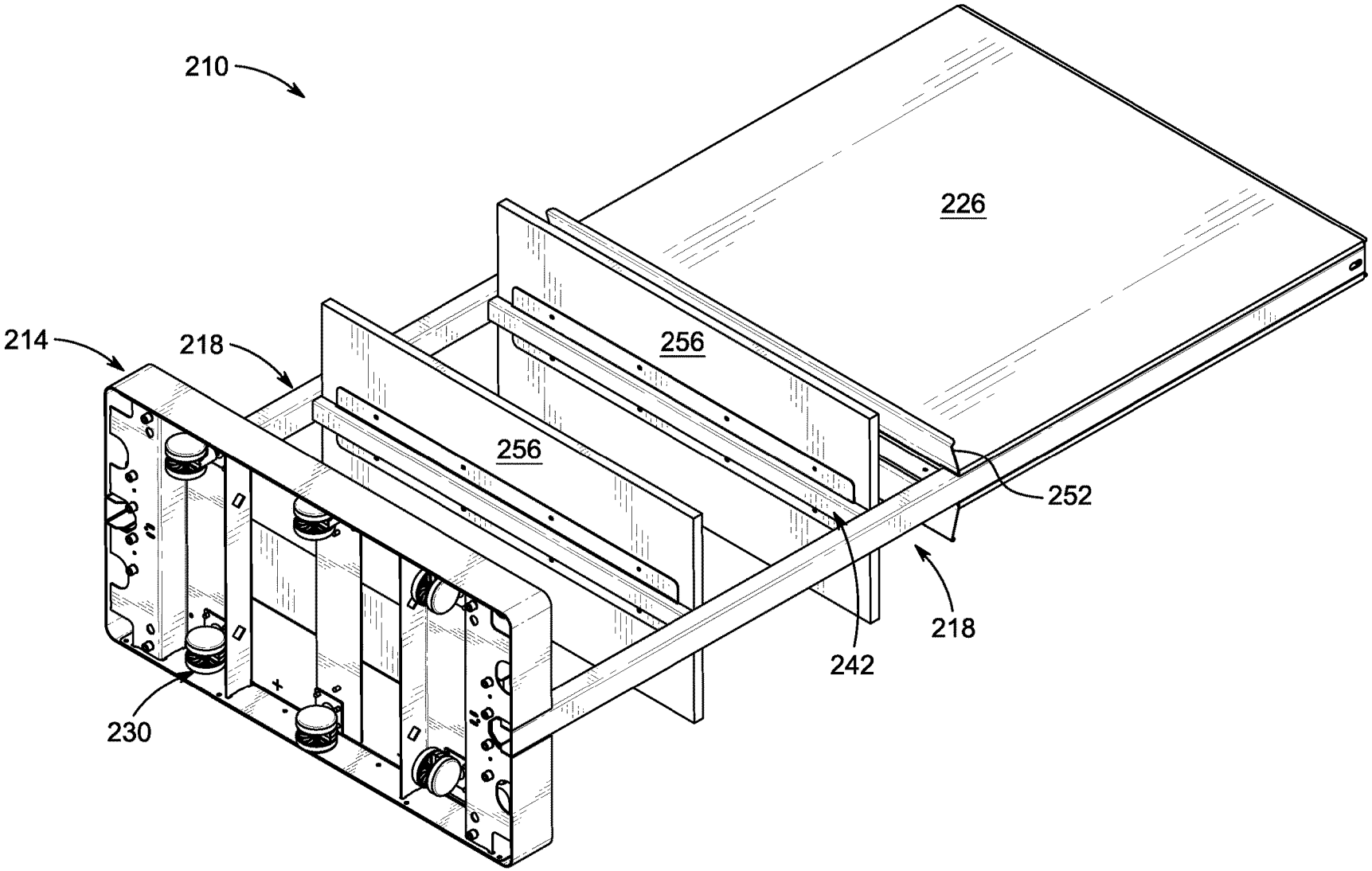
FIG. 6A is a bottom perspective view of a mobile wall according to another embodiment of the invention.

Referring now to FIGS. 6A-7, the system 100 of mobile walls will now be further described. Each mobile wall 10 in the wall system 100 includes complimentary alignment pins 22 and apertures 66 such that each wall 10 in the wall system 100 is capable of being non-lockingly aligned with adjacent mobile walls 10, regardless of wall accessory 26 configuration.

FIG. 6A illustrates another mobile wall 210. The illustrated mobile wall 210 is similar to the mobile wall 10 described above and includes a base 214 supported on a plurality of ground engaging members 230 (e.g., caster wheels), a frame structure 218, and alignment pins (not shown). In the illustrated embodiment, the mobile wall 210 includes different wall accessories than the mobile wall 10. For example, the illustrated mobile wall 210 includes a cladding 226 on an upper half of the frame structure 218. The cladding 226 may be a whiteboard or chalkboard having a utensil tray 252 mounted beneath it. The cladding 226 and the utensil tray 252 is located on both sides of the frame structure 218. The mobile wall 210 also includes shelves 256 on a lower half of the frame structure 218 beneath the cladding 226 and supported on crossbars 242.

Figure 6B:
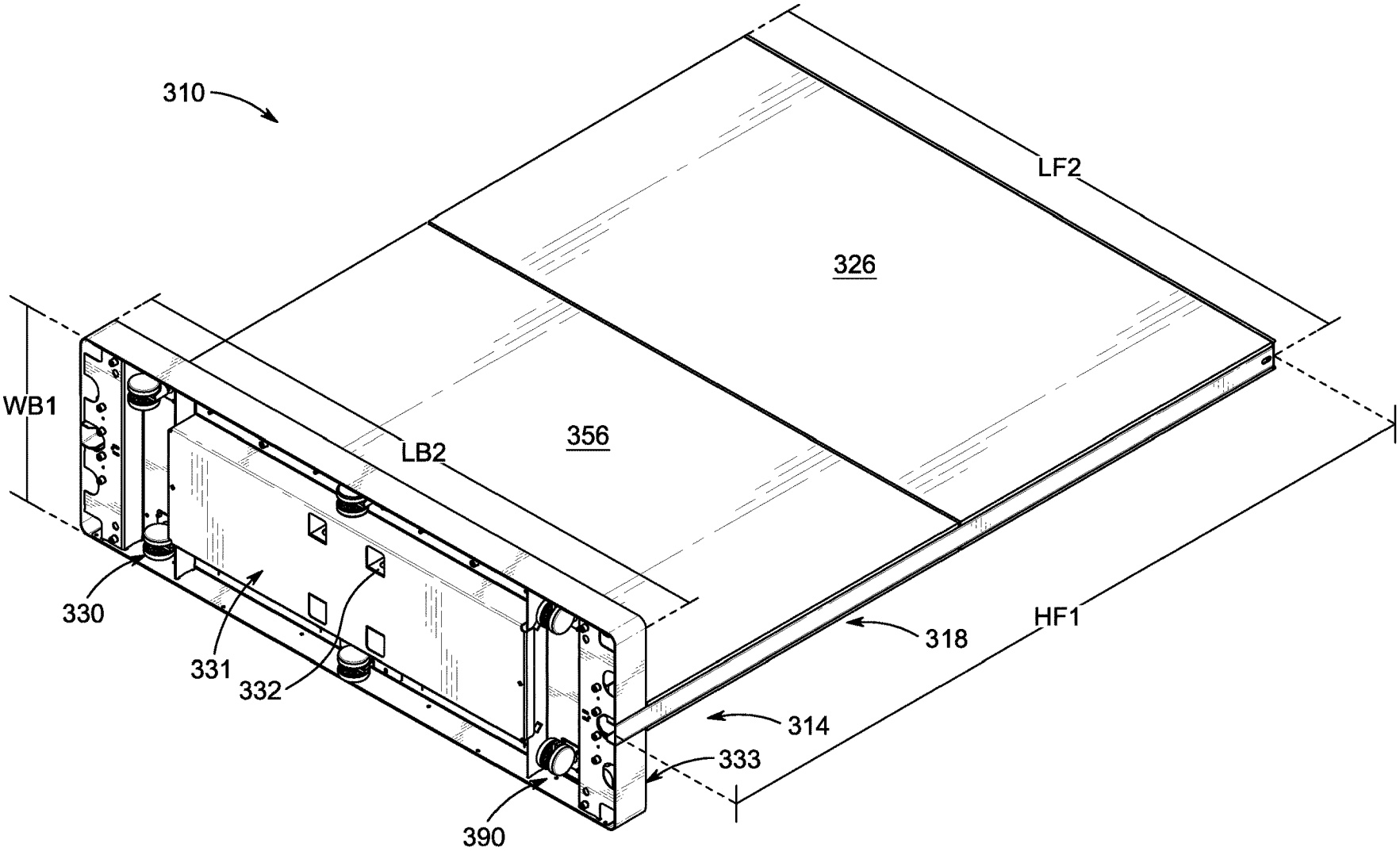

FIG. 6B illustrates yet another mobile wall 310. The illustrated mobile wall 310 is similar to the mobile wall 10 described above and includes a base 314, a frame structure 318, and alignment pins (not shown). In the illustrated embodiment, the base 314 is has a base length LB2 that is greater than the base length LB1 of the base 14, and the frame structure 318 has a frame length LF2 that is greater than the frame length LF1 of the frame structure 18. For example, the base length LB1 and the frame length LF1 of the mobile wall 10 may be about 36 inches, while the base length LB2 and the frame length LF2 of the mobile wall 310 may be about 60 inches. In other embodiments, the mobile walls 10, 310 may have other dimensions.

The base 314 of the mobile wall 310 includes a pocket 390 recessed on a bottom side of the base 314. The pocket 390 is shaped to conceal ground engaging members 330 (e.g., caster wheels) of the base 314, which may improve cosmetic appeal and protect the ground engaging members 330. The base 314 also includes a tray 331 for holding a weight 332. The weight 332 functions as a counterweight that is placed in the tray 331 to improve the stability of the mobile wall 310 and counter act any tipping action that may occur to the wall 310. The base 314 further includes an upper panel 333 covering the tray 331 and hiding the weight 332 in the base 314.

The illustrated mobile wall 310 also includes different wall accessories than the mobile 10. In the illustrated embodiment, the mobile wall includes an upper cladding 326 and a lower cladding 356 on both sides of the frame structure 318, creating a solid looking wall.

FIG. 7 illustrates a mobile wall system 400 including five mobile walls 510, 610, 710, 810, 910. The first mobile wall 510 includes an upper whiteboard and lower shelves. The second mobile wall 610 is a relatively wide wall and includes an upper cladding and lower shelves. The third mobile wall 710 includes upper cladding and lower cladding. The fourth mobile wall 810 is a relatively wide wall and includes upper cladding and lower cladding. The fourth mobile wall 810 also includes a mount to support a display 812, such as a TV screen or monitor. The fifth mobile wall 910 includes five shelves, similar to the mobile wall 10. Each of the mobile walls 510, 610, 710, 810, 910 may include alignment pins and/or apertures (similar to the alignment pins 22 and the apertures 66 described above) to align the mobile walls 510, 610, 710, 810, 910 with one another in non-locking alignment. Although the mobile walls 510, 610, 710, 810, 910 are presented in a specific order, the mobile walls 510, 610, 710, 810, 910 may align with each other in any order, and not all of the mobile walls 510, 610, 710, 810, 910 need be present in the system 400.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A mobile wall comprising:

a base including one or more ground engaging members configured for moving the base along a surface;

a first vertical support extending from the base, the first vertical support including a first aperture;

a second vertical support extending from the base and spaced apart from the first vertical support;

a crossbar extending between the first and second vertical supports; and an alignment pin moveably supported on the crossbar adjacent the first vertical support, the alignment pin selectively moveable between a retracted position, in which the alignment pin is retracted into the first aperture, and an extended position, in which at least a portion of the alignment pin extends outwardly from the first aperture, wherein the alignment pin is selectively receivable in an aperture of another mobile wall while in the extended position to align the mobile wall with the another mobile wall.

2. The mobile wall of claim 1, wherein the mobile wall is configured to be retained in nonlocking alignment with the another mobile wall while the alignment pin is in the extended position and received in the aperture of the another mobile wall.

3. The mobile wall of claim 1, wherein the alignment pin is moveable between the retracted and extended positions along a first direction, and wherein the mobile wall is separable from the another mobile wall along the first direction while the alignment pin is in the extended position and received in the aperture of the another mobile wall.

4. The mobile wall of claim 3, wherein the mobile wall is constrained from moving relative the another mobile wall in a second direction that is normal to the first direction while the alignment pin is in the extended position and received in the aperture of the another mobile wall.

5. The mobile wall of claim 1, wherein the crossbar is one of a plurality of crossbars, wherein the plurality of crossbars extends between the first and second vertical supports, and wherein each of the plurality of crossbars is configured to support a wall accessory.

6. The mobile wall of claim 5, wherein the wall accessory includes a cladding, a shelf, or both.

7. The mobile wall of claim 1, wherein the second vertical support includes a second aperture, wherein the alignment pin is a first alignment pin, and the mobile wall further comprising:

a second alignment pin moveably supported on the crossbar adjacent the second vertical support, the second alignment pin selectively moveable between a retracted position, in which the second alignment pin is retracted into the second aperture, and an extended position, in which at least a portion of the second alignment pin extends outwardly from the second aperture.

8. The mobile wall of claim 1, wherein the first vertical support includes an outer surface, and wherein the alignment pin is recessed relative to the outer surface while in the retracted position.

9. The mobile wall of claim 1, wherein the alignment pin includes an actuator configured to be engaged by a user to move the alignment pin between the retracted position and the extended position.

10. The mobile wall of claim 9, wherein the actuator extends upwardly from an upper surface of the crossbar.

11. The mobile wall of claim 1, wherein the alignment pin is linearly slidable between the retracted position and the extended position.

12. The mobile wall of claim 1, wherein the base further includes a tray to hold a weight.

13. The mobile wall of claim 1, wherein the ground engaging members are caster wheels.

14. The mobile wall of claim 1, wherein the base has a base length, a base width, and a base height, wherein the first vertical support, the second vertical support, and the crossbar form a frame structure having a wall length, a wall width, and a wall height, and wherein the base length is substantially equal to the wall length, the base width is greater than the wall width, and the base height is less than the wall height.

15. A mobile wall comprising:

a base including one or more ground engaging members configured for moving the base along a surface;

a vertical frame structure extending upwardly from the base, the vertical frame structure including an outer surface and an aperture formed in the outer surface; and an alignment pin moveably supported by the vertical frame structure, the alignment pin having a distal end configured to engage another mobile wall to align the mobile wall with the another mobile wall, wherein the alignment pin is extendable out of the aperture such that the distal end is spaced a first distance from the outer surface, wherein the alignment pin is retractable into the aperture such that the distal end is spaced a second distance from the outer surface that is equal to or greater than the first distance, wherein when the alignment pin is retracted into the aperture, the aperture is configured to selectively receive an alignment pin of the another mobile wall, wherein the alignment pin includes an actuator configured to be engaged by a user to move the alignment pin relative to the vertical frame structure, and wherein the actuator extends upwardly from an upper surface of the vertical frame structure.

16. The mobile wall of claim 15, wherein the vertical frame structure includes a first vertical support extending upwardly from the base, a second vertical support extending upwardly from the base and spaced apart from the first vertical support, one or more crossbars extending between the first and second vertical supports, and one or more wall accessories supported by the one or more crossbars.

* * * * *